United States Patent [19]

Ross

[11] 4,221,104

[45] Sep. 9, 1980

[54] FRUIT PROCESSING APPARATUS AND METHOD

[75] Inventor: Edward E. Ross, San Rafael, Calif.

[73] Assignee: Del Monte Corporation, San Francisco, Calif.

[21] Appl. No.: 970,323

[22] Filed: Dec. 18, 1978

[51] Int. Cl.[3] ..... B65B 63/00; A21C 15/04

[52] U.S. Cl. ..... 53/435; 53/515; 83/27; 83/409.2; 83/435.2

[58] Field of Search ..... 53/435, 515; 83/27, 83/104, 409.1, 409.2, 435.2

[56] References Cited

U.S. PATENT DOCUMENTS

| | | | |
|---|---|---|---|
| 2,076,942 | 4/1937 | Gardner | 53/515 X |
| 2,884,973 | 5/1959 | Crow | 83/409.1 X |

*Primary Examiner*—Travis S. McGehee

*Attorney, Agent, or Firm*—Flehr, Hohbach, Test, Albritton & Herbert

[57] ABSTRACT

Apparatus for producing slices of pitted cherries. It carries out successive orientation and slicing operations with direct introduction of a predetermined count of slices into containers (e.g., cans or jars). The desired count for each container can be adjusted to meet requirements.

14 Claims, 9 Drawing Figures

FRUIT PROCESSING APPARATUS AND METHOD

This invention relates generally to apparatus and methods for the processing of fruit products. More particularly it pertains to apparatus and methods involving slicing of fruit products like maraschino cherries.

Cherries of the maraschino type are commonly marketed in sealed containers (e.g., glass jars or cans) and are extensively used in so-called fruit cocktail. Fruit cocktail generally consists of various processed fruit pieces together with slices of pitted maraschino cherries. The cherry slices may be added to the containers together with other fruit pieces, or they may be added after introduction of other fruit pieces, in which event they are visible at the top of the jar or can.

A typical process for the manufacture of maraschino cherries used for fruit cocktail consists of subjecting the red cherries to brine containing sulfur dioxide and lime, after which the bleached and hardened fruit is stemmed, size graded, pitted and sliced. Pitting and slicing is accomplished on an "Ashlock" type cherry pitting machine. The cherries fed to such a machine are singulated into holes approximately 1 inch in diameter. The cherries are then transferred to another portion of the machine where they are deposited into curved cups. There is a vertical spinning probe for each cup which is adapted to be disposed axially within the lower cup portion. A cherry deposited within the cup is oriented to a position in which its stem cavity is lowermost. This is effected by rotation of the cherry due to frictional contact between the probe and the cherry surface, the rotation continuing until the upper end of the probe is directly beneath the stem cavity. When the orientation is reached, rotation of the cherry ceases because it no longer has sufficient friction contact with the spinning probe. A pitting member or pin is then projected through the cherry substantially coincident with its natural axis. After retraction of the pitting pin each cherry is sliced in half by a blade which rotates in a vertical plane. The halved cherries then may be further processed as by boiling in dyeing tanks. Considerable damage occurs as a result of conveying and processing of the halved cherries. This is because the cherry halves are more susceptible to damage than the whole pitted cherries. The flat surface of a cherry half tends to adhere to wet surfaces, thus making it difficult to convey and handle the halves in an orderly fashion. Various brush and scraper devices are common used during transfer of the cherry halves to containers, thereby causing substantial damage and creating a high percentage of broken pieces and fragments. In general it may be stated that while whole pitted cherries are not readily susceptible to damage and are easy to handle and count, the cherry slices are difficult to handle, they are susceptible to damage, and they are difficult to count.

With respect to the introduction of cherry halves into fruit cocktail containers, the present practice is to use a device consisting of volumetric measuring pockets disposed on a rotating disk. The cherry halves are caused to drop at random into the pockets, but because of their shape they tend to bridge or contour stack so that the count produced when the measured volume is delivered into the container varies greatly. By way of example, if four halves are desired for each can, the actual count may vary as much as from two to seven halves. Cherries are known to be relatively expensive compared to other fruits in a cocktail pack. Minimum counts for each grade and size are required by the Federal Food and Drug Administration. It is common when using a volumetric pocket-type filler to avoid an illegal low count of cherry halves by using a higher target count, which is a wasteful expedient. If a more accurate filling device were available, it would avoid significant product giveaway experienced with such practice. If the count of cherry halves is below that set by the Federal Food and Drug Administration for fruit cocktail, the pack must be downgraded and sold at a discount.

An object of the present invention is to provide an apparatus and method which produces slices of maraschino cherries in such a manner that they can be introduced into cans with accuracy with respect to the desired count, thus effecting a product saving.

Another object is to provide an apparaus and method which serves to introduce a predetermined number of uniform slices of cherries into the containers, and which dispenses with the use of separate counting means.

Another object is to avoid mutilation or breakage of the cherry slices during and following the slicing operation and during introduction of the slices into the containers.

Another object is to provide an automated machine and method which is fed with pitted maraschino cherries and which proceeds to carry out the operations of orienting the cherries with respect to the pitting hole and natural axis, slicing the cherries into halves in such a manner that the pitting holes do not extend through the slices, and introduction of a predetermined number of the slices into each of the containers.

Referring to the attached drawing:

FIG. 1 of the drawing schematically illustrates apparatus incorporating the invention.

Figure 1:
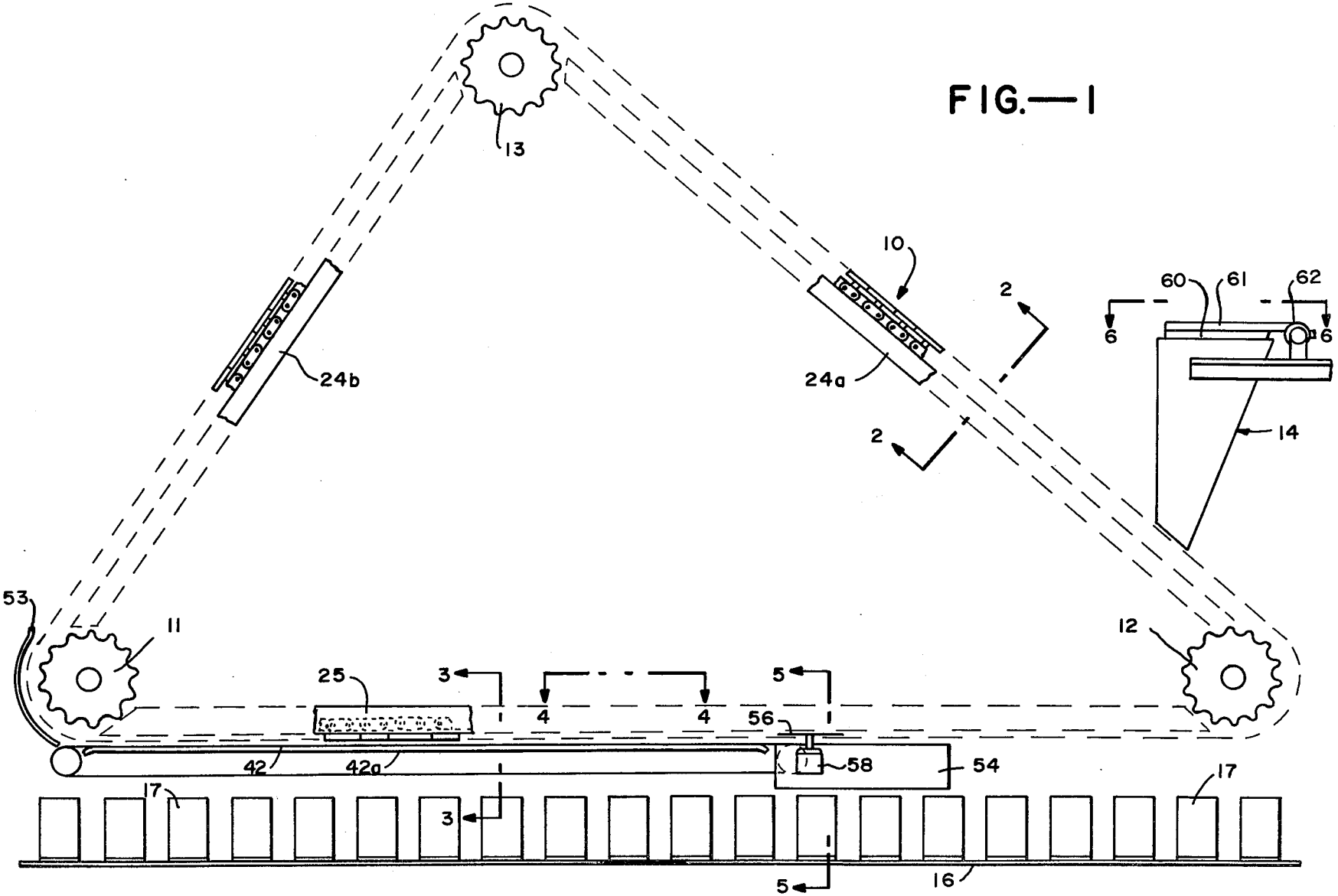

FIG. 1 schematically illustrates a conveyer or transport means 10 which is made as an endless articulated assembly and which is trained over the guide means or sprockets 11, 12 and 13. The upwardly inclined run of the conveyer passes beneath the feed hopper 14, and the lower horizontal run passes through orienting and slicing regions. The schematically illustrated belt conveyer 16 serves to carry containers 17, such as glass jars or cans, through a region in which predetermined numbers of cherry slices are introduced into the same.

Figure 4:
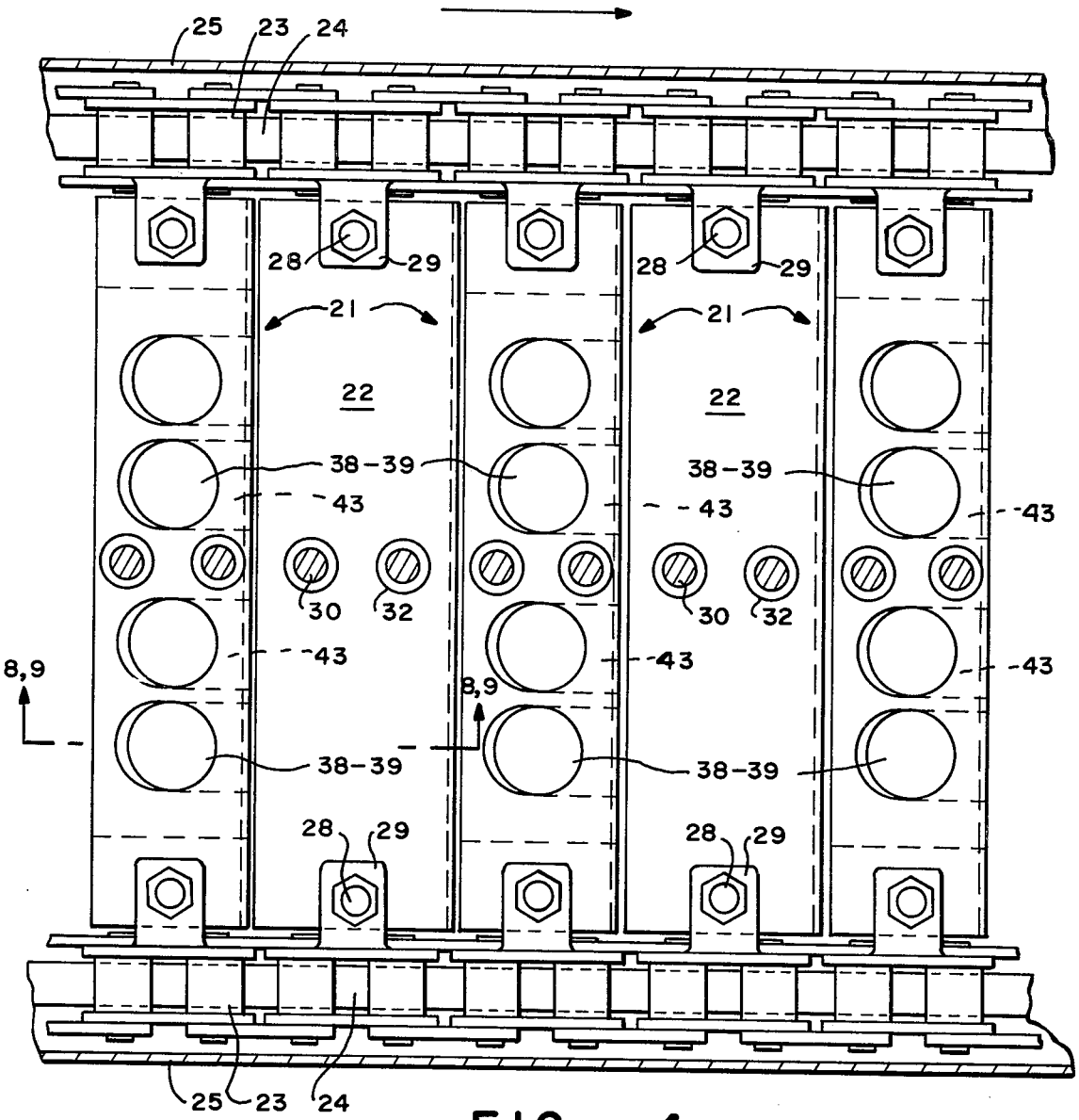
FIG. 4 is a plan view of a portion of the conveyer means which transports the cherries through the orienting and slicing regions.

The conveyer means consists of a plurality of flight units which serve to carry the cherries through orienting and slicing operations. Referring to FIG. 4, the units 21 serve to carry the cherries, while the blank flight units 22 are disposed between units 21. The end portions of both the units 21 and the blanks 22 are attached to the chains 23 which for the lower run of the conveyer are tracked on the rails 24. These rails are carried by the supporting framework members 25 of the machine.

Figure 3:
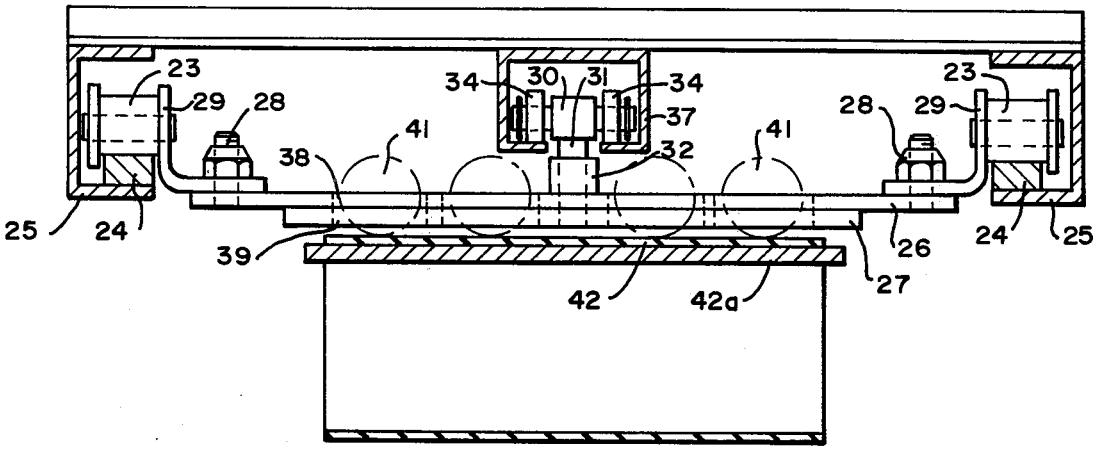
FIG. 3 is a cross-sectional view taken along the line 3—3 of FIG. 1, within the orienting region.

The flight units 21 of the conveyer means (FIGS. 3 and 4) consist of upper and lower plate-like members 26 and 27 which have opposed planar faces. The end portions of each member 26 are secured as by means of bolts 28 to the L-shaped links 29 of the chains 23. Each lower member 27 has its central portion fixed to the lower ends of the rods 30 which are slidably accommodated within the sleeves 32, the latter being fixed to the upper member 26. The upper end of the rods 30 are secured to the connecting member 31, which in turn is secured to a cross rod 33 that is provided with rollers 34. These rollers are operated upon the tracks 36 which are formed as a part of the channel-shaped structural member 37. It will be evident that the position of the upper member 26 of the unit 21 is determined by the engagement of the chains 23 with the tracks 24. Likewise, the position of the lower member 27 relative to the upper member 26 is determined by the engagement of rollers 34 with the tracks 36. As will be presently explained, for the slicing operation the upper member 26 is raised by virtue of a raised portion of the track 24 engaged by the chain 23, thereby providing a desired spacing between the members 26 and 27.

The members 26 and 27 are provided with aligned openings 38 and 39 which are dimensioned to loosely accommodate cherries 41, as illustrated (FIG. 3) in dotted lines. As will be presently explained in greater detail, the cherries in the orienting region are supported upon the upper surface of the belt 42. The upper run of this belt is shown supported by plate 42*a*. During the time a unit is progressing over the belt 42 in the orienting region, they are caused to rotate at a speed determined by the rate of movement of the unit relative to the rate of movement in the same direction of the belt 42. In actual practice, the belt 42 is driven at such a speed that its forward movement is somewhat less than the rate of forward movement of the units 21, whereby the cherries are rotated at a desired predetermined speed for optimum orientation.

Figure 8:
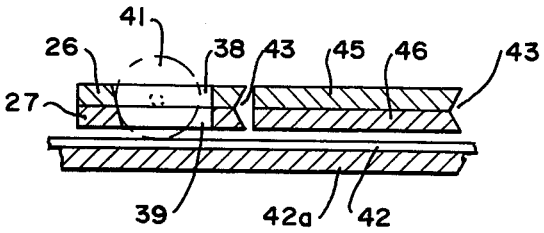
FIG. 8 is a cross-sectional view taken along the line 8—8 of FIG. 4 and showing one of the conveyer flight units with a cherry being carried by the same.
Figure 9:
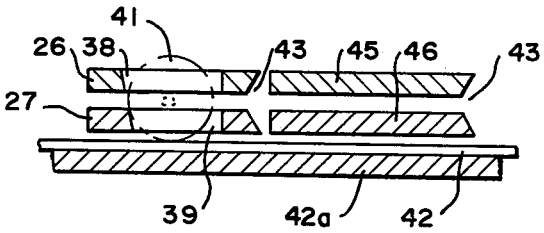
FIG. 9 is a cross-sectional view like FIG. 8 but showing separation of the upper and lower parts to accommodate slicing means.

FIG. 8 shows an individual cherry 41 loosely accommodated within the openings 38 and 39 of the members 26 and 27. It is assumed in this instance that the movement is toward the right and parallel to the surface formed by the upper surface of the belt 42. It has been found that if these holes are made by a simple drilling operation the thrust applied by one side of the holes against the adjacent side of the cherry does not produce the desired spinning action of the cherry for proper orientation. However, when the trailing sides of the openings are bevelled (FIGS. 4 and 8), the forward thrust is applied at a level below the center of the cherry. Thrust applied in this manner has been found to cause the cherry to rotate as it is carried over the surface of the belt 42 without slippage or erratic action. Also (FIGS. 4 and 8) it has been found desirable to relieve the lower member 27 as indicated at 43 to facilitate introducing the cherries into the openings in the feed or loading region, as will be presently explained. When the members 26 and 27 of the units 21 are advancing over the belt 42 at a speed such as will cause rotation of the cherries 41, the cherries, because of their natural configuration, are oriented to positions in which natural axes are parallel to the surface of belt 42. Assuming that the cherries have been pitted by movement of a pitting member through the natural axis, this means that the pitting hole indicated at 44 will assume an oriented position parallel to the upper surface of belt 42 and a right angle to the direction of movement.

The trailing edges (FIG. 8) of members 26 and 27 are preferably oppositely bevelled as indicated, thereby providing clearance for aticulation between the trailing edge of each unit and the advancing edges of the adjacent blank units.

The blank flight units 22 consist of upper and lower members 45 and 46, which are carried in the same manner as the members 26 and 27 of units 22. Thus the ends of each member 45 are secured to chain links 48 and the central portion of each member 46 is connected to rods 49 which extend through sleeves 50 carried by the member 51, cross rod 52 and rollers 53.

Slicing of the cherries is carried out after they have been oriented, and employs the slicing blades 56. These blades (FIG. 5) are circular and are secured to the shafts 57 of the electric motors 58.

Figure 5:
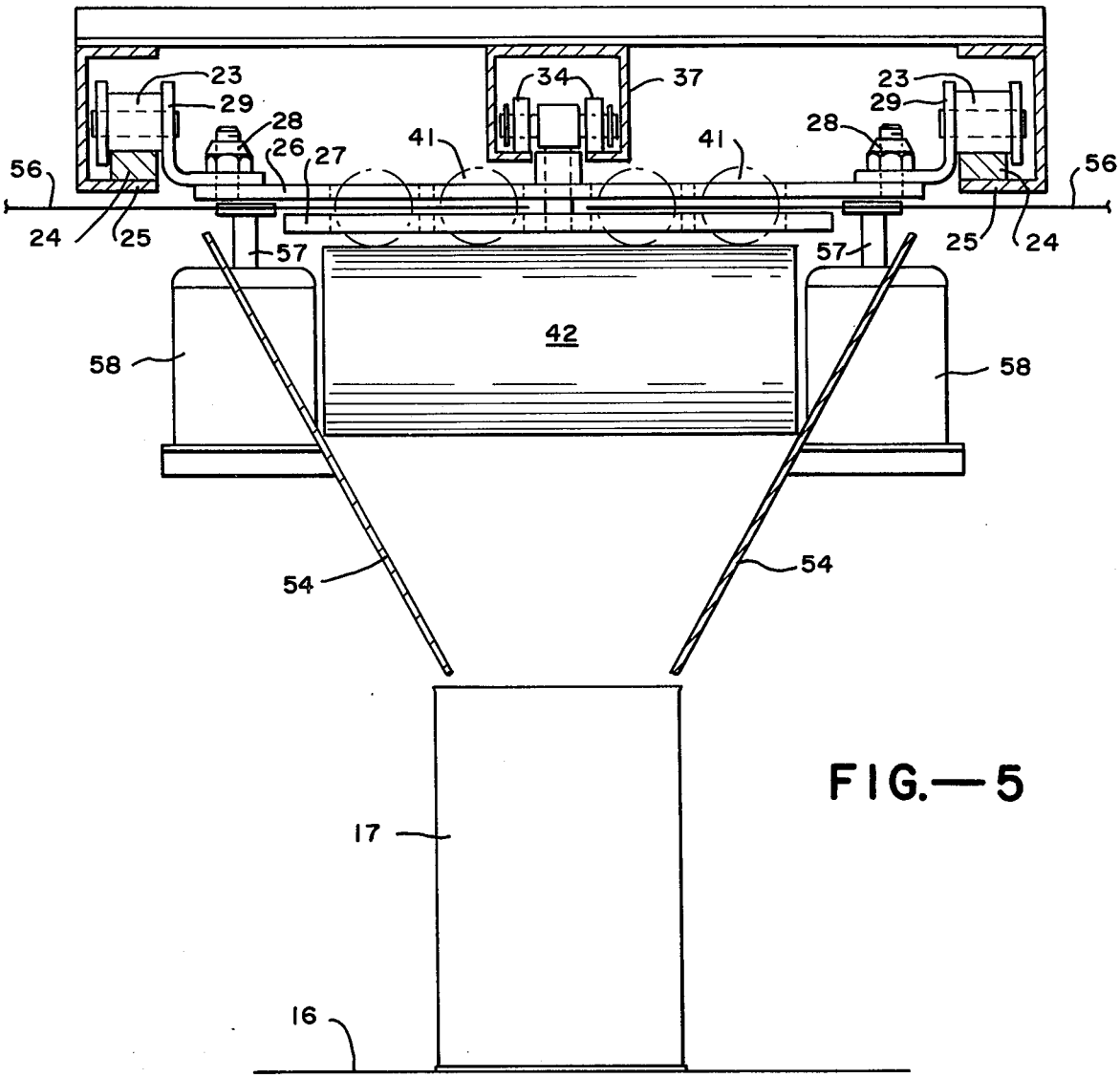
FIG. 5 is a cross-sectional view taken along the line 5—5 of FIG. 1, illustrating slicing of the cherries and showing the means for collecting the cherries for delivery into the underlying containers.
Figure 7:
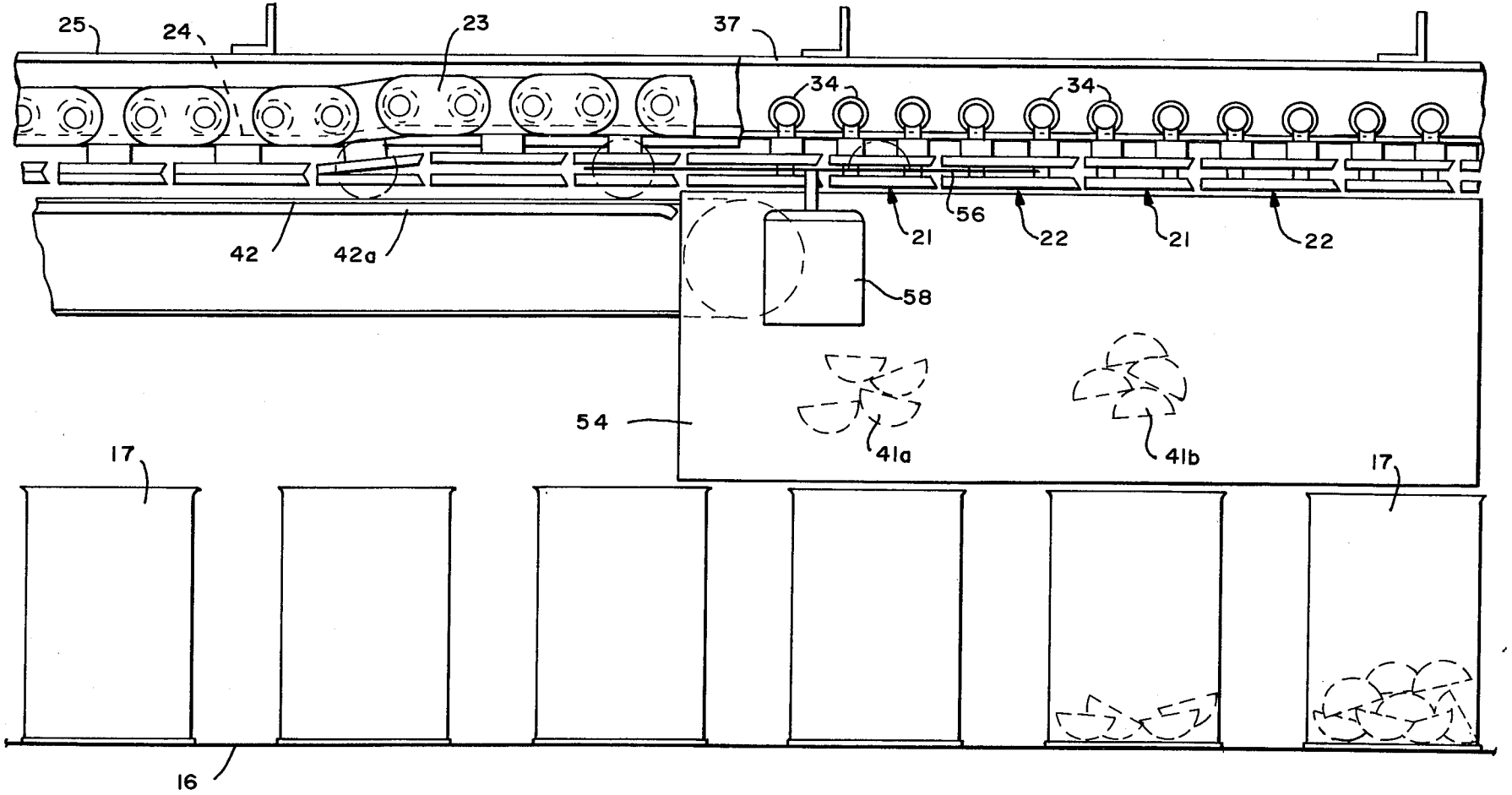
FIG. 7 is a side elevation of a portion of the horizontal run of the conveyer means on an enlarged scale.

As each unit 21 approaches the end of the orienting region and passes into the slicing region, the upper and lower members 26 and 27 of each of these units, and also the upper and lower members 45 and 46 of the blank units, are caused to be separated in the manner shown in FIG. 5. Separation is carried out by providing a raised portion 24*a* of the track 24 whereby the chains 23 are elevated a predetermined amount as they approach the end of the orienting region, thereby separating the members 26 and 27 by a small predetermined amount. Separation of members 26 and 27 (FIG. 5) enables them to pass above and below the blades 56, but in close proximity with the same. The cherries are carried against the cutting edges of the blades whereby they are restrained from further rotation and are sliced into halves. FIG. 7 shows the lower halves 41*a* dropping off the end of the belt 42 into the collecting hopper 54 and into an underlying container 17. The upper halves 41*b* remain upon the upper surfaces of the blades, but are freed to fall down after being carried beyond the zone of operation of the blades. The halves 41*b* fall into the same containers 17 as the halves 41*a* when the containers are carried forward at a speed synchronous with movement of the units 21. After the cherry halves have been deposited within the containers 17, the members 26 and 27 are caused to return to their closed position in contact with each other for the remainder of their movement back to the horizontal run of the conveying means 10.

Figure 2:
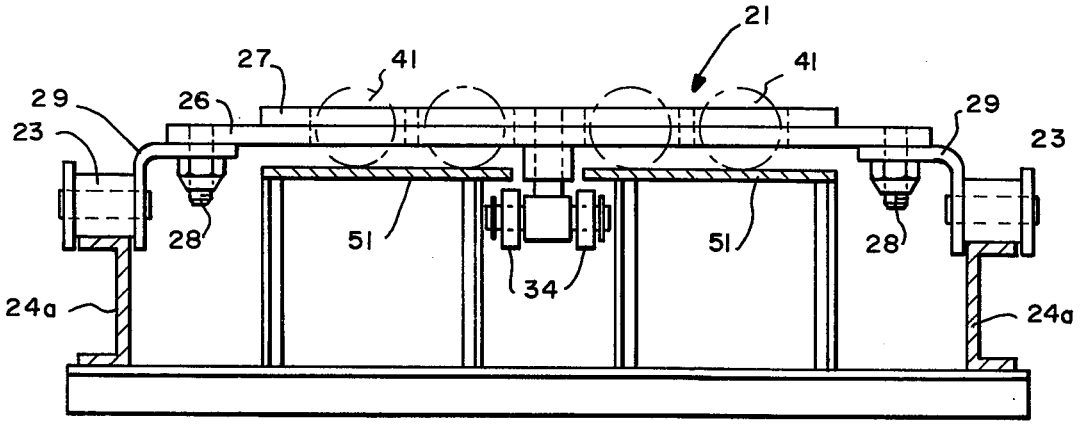
FIG. 2 is a cross-sectional view taken along the line 2—2 of FIG. 1.

The hopper 10 receives the maraschino cherries and serves to feed them into the aligned openings 38 and 39 when the opposed faces of the members 26 and 27 are in contact. Upon passing about the sprockets 12, the units 21 are inverted whereby the recessing 43 in each member 27 is now uppermost. For the upper inclined runs the conveyer chains 23 are tracked upon the rails 24*a* and 24*b* (FIG. 1). Upon passing across the lower open end of the hopper 14, cherries drop into the openings 38 and 39 and are then carried over the sprockets 13 back to the sprockets 11. Laterally spaced plates 51 (FIG. 2) underlie the upwardly inclined and downwardly inclined portions of the conveyer and serve to retain the cherries within the openings of the flight units. As the conveyer passes about the sprockets 11, with inversion of the units 21, the cherries are retained within the openings by the arcuate shield 53.

Figure 6:
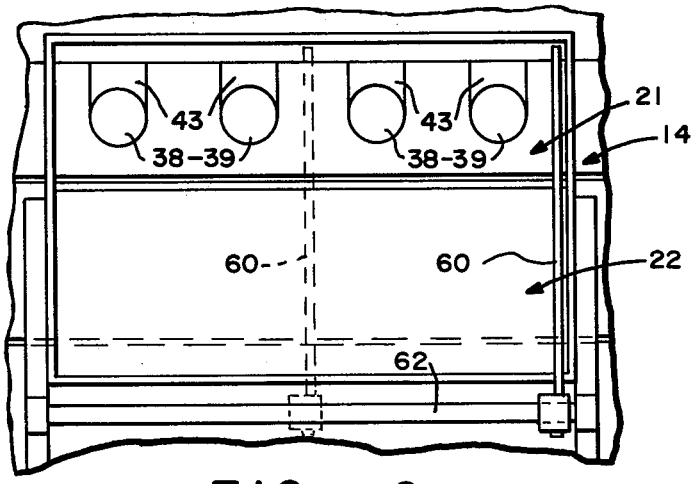
FIG. 6 is a plan view of the feed hopper on an enlarged scale relative to FIG. 1.

It is desirable to provide means for selecting the number of cherries to be carried by each unit 21, whereby a desired number of cherry halves are introduced into each container. One means for this purpose is shown in FIG. 6. The hopper 14 is provided with an adjustable partition 60 which is carried by suitable means such as the arm 61 that is adjustably fixed to the supporting rod 62. Assuming that this partition is in a middle position and that charries are introduced into only one half of the hopper 14, then for units of the type illustrated having four openings in all, only four cherry halves will be deposited in each of the units. Similarly the partition can be otherwise positioned to provide the count desired. In this connection, it will be evident that each unit of the conveyor may be so constructed that it provides holes for accommodating more than four cherries. By way of example, even counts of two, four, six, eight, etc. cherry halves are obtained when one, two, three or four cherries are sliced.

In the foregoing description it is assumed that the containers are moving at the same speed as the conveyor 10. When operated in this manner, one container will receive both upper and lower halves of each sliced cherry. However, by operating the container conveyer at twice the speed of the conveyer 10, the lower cherry halves drop into one container, while the upper halves drop into the next following container. When the machine is caused to operate in this manner, each can receives the same number of halves as the number of whole cherries allowed to enter the flight pocket, which may be an even or uneven number.

It will be evident from the foregoing that the apparatus and its method of operation makes possible the fully automated orientation and slicing of maraschino cherries or similar fruit, and that the slices produced will be of uniform size and will not be mutilated by the presence of pitting holes extending through the slices. In addition, a predetermined count is provided for each container without the use of special counting devices, because the count is determined by a predetermined number of cherries.

What is claimed is:

1. In apparatus for producing slices of pitted cherries, first conveying means comprising a plurality of connected flight units for carrying and progressing the cherries through orienting and slicing regions, each of said units having a predetermined number of vertically extending openings each dimensioned to loosely accommodate a pitted cherry, means cooperating with the conveying means in the orienting region for orienting the cherries to positions in which their axes are substantially parallel, said orienting means forming a surface underlying the conveying means in the orienting region and disposed whereby cherries disposed in said openings are supported on said surface, relative movement between the units and said surface causing rotation of the cherries and resulting orientation of the same with their axes parallel to said surface, means in the slicing region cooperating with the conveying means for slicing the oriented cherries coincident with their axes, and means for delivering a predetermined number of the cherry slices to each of a series of containers.

2. Apparatus as in claim 1 in which each of said units comprises upper and lower cooperating members having adjacent planar faces, the slicing means in the slicing region being disposed to operate between said members.

3. Apparatus as in claim 1 in which each of said units comprises upper and lower members having adjacent planar faces, said openings exending through both said members, means for effecting separation between said members by a predetermined amount as each unit is progressed into the slicing region, the slicing means being operable in the space between said members in the slicing region for slicing the cherries into halves.

4. Apparatus as in claim 1 in which said surface is formed by the upper run of an endless belt, and in which the endless belt moves at a speed differing from the speed of movement of the conveyer means.

5. Apparatus as in claim 1 in which the orienting and slicing means are constructed to cause the slices to be discharged downwardly in spaced regions.

6. Apparatus as in claim 1 in which a second conveying means is disposed beneath the slicing region, the second conveying means serving to carry a series of containers at a speed of movement such that each container receives a predetermined count of cherry slices, and hopper means underlying the slicing region serving to direct sliced pieces of the cherries into the containers.

7. Apparatus as in claim 6 in which the first conveyer means forms an endless assembly having a lower run extending through said orienting and slicing regions, and having an upper run extending through a feeding region, and means in said feeding region for introducing cherries into the openings of said units.

8. Apparatus as in claim 7 in which the openings in said units form a series of openings extending laterally to the direction of movement of the same, the means in said feeding region being adjustable for causing cherries to be introduced into some but not all of said openings.

9. A fruit processing method for producing and delivering a predetermined count of cherry halves to containers, the method making use of a conveyer having flight units for progressing pitted cherries through orienting and slicing regions, the steps of introducing a predetermined number of whole pitted cherries into upright holes provided in the conveyer flight units, orienting the cherries within the holes as they progress through the orienting region by causing them to spin about their axis while within the openings and while being progressed through the orienting zone, discontinuing such spinning of the cherries as they progress into the slicing region, slicing of the cherries as they progress through the slicing region into upper and lower halves, and then causing a predetermined number of the cherry halves to be delivered into containers.

10. A method as in claim 9 in which both upper and lower cherry halves are delivered into the same container.

11. A method as in claim 9 in which the lower cherry halves are delivered into one container and the upper halves delivered into a separate container.

12. A fruit processing method for producing and delivering a predetermined count of cherry halves to containers, the method making use of a conveyer having flight units for progressing pitted cherries through orienting and slicing regions, the flight units comprising upper and lower parallel flight members provided with a series of holes extending vertically through the same and adapted to accommodate cherries, the steps of introducing a predetermined number of whole cherries into the holes of each flight unit, orienting the cherries within the holes as they progress through the orienting region, causing the flight members to be vertically separated as they progress through the slicing region, causing the cherries to be sliced into halves on a plane coincident with the natural axis of the cherries, the slicing plane being between the flight members and parallel to the opposed surfaces of the members, and then causing a predetermined number of the cherry halves to be delivered into containers.

13. A method as in claim 12 in which both upper and lower cherry halves are delivered into one can.

14. A method as in claim 13 in which the lower cherry halves are delivered into one can and the upper halves delivered into a separate container, the units being linked together with intervening blank members.

* * * * *